United States Patent [19]

Roberson, Sr.

[11] Patent Number: 4,917,154

[45] Date of Patent: Apr. 17, 1990

[54] FENCEWRENCH

[76] Inventor: Rhubert B. Roberson, Sr., Rte. #1, Box 423, Dunlap, Tenn. 37327

[21] Appl. No.: 308,799

[22] Filed: Feb. 10, 1989

[51] Int. Cl.[4] ..... B21F 15/04

[52] U.S. Cl. ..... 140/57; 140/117; 140/123

[58] Field of Search ..... 140/52, 56, 57, 102.5, 140/106, 117, 118, 120, 123, 124; 7/117

[56] References Cited

U.S. PATENT DOCUMENTS 358,044 2/1887 Lea ..... 140/102.5
519,603 5/1894 Forsythe ..... 140/117
577,861 3/1897 Kirby ..... 140/57
3,213,899 10/1965 Fettkether ..... 140/118

FOREIGN PATENT DOCUMENTS 106083 12/1938 Australia ..... 140/123

*Primary Examiner*—Lowell A. Larson

[57] ABSTRACT

This invention relates to an improved method and apparatus for attaching wire clips to a metal woven wire fence or barbed wire and holding same firmly to metal fence posts. It also relates to tightening sagging metal wire, splicing metal wire, bending metal clips and attaching same to other wire, removing old clips from existing posts and the general handling of metal wire.

2 Claims, 3 Drawing Sheets

FENCEWRENCH

BACKGROUND OF THE INVENTION

The process of attaching and holding a woven wire fence or barbed wire to metal fence posts is accomplished with the use of wire clips. Upon positioning said fence or barbed wire against the metal posts, each clip has one end fastened in a coil around the fence wire or barbed wire on one side of said post, then is drawn tightly away from the fence or barbed wire to encompass the post and is attached in a coil to the fence or barbed wire on the opposite side of said post.

To fasten these clips tightly with conventional tools, such as a screw driver or pliers, is very difficult. It is especially difficult with a woven wire fence, as the openings between the woven wire limits the working space. This invention relates to the improvement of wire handling and wire fence installation.

SUMMARY OF THE INVENTION

The purpose of this invention is to provide an improved, inexpensive method and apparatus for attaching metal clips to fence wire or barbed wire and holding same securely to metal fence posts, for tightening sagging wire, for splicing metal wire, for removing old clips from existing posts and the general handling of metal wire.

Various other features of the method and apparatus of the present invention will become obvious to those skilled in the art upon reading the disclosure set forth hereinafter.

BRIEF DESCRIPTION OF DRAWINGS

Referring now to the drawings, the apparatus is shown as a tool with its various features and how it is used in attaching wire fencing to metal posts.

DETAILED DESCRIPTION

Figure 1:
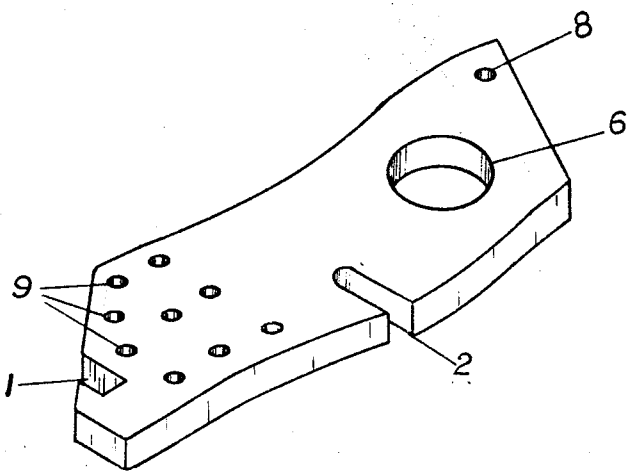
FIG. 1 is a view of the apparatus showing its various features.

There is illustrated in FIG. 1 a tool semi-flat and oblong with semi-parallel tapered ends. One end has an open slot 1 near its tapered end, said slot being shallow in depth from the tools outer sloping edge and creates a buttonhook type look. The slot is wide and deep enough to fit over a wire in a woven wire fence or a barbed wire. Near this slot 1 and toward the tool center, there exists several holes 9, positioned across the width of the tool. Said holes are large enough in diameter to accommodate a wire clip, fence wire or barbed wire. A second slot 2 is located near the tool center and opens on the opposite side of the tool from the slot 1 opening. At the tools opposite end from the end that contains slot 1, there exists a hole 8 near the tapered end. Said hole 8 is large enough in diameter to accommodate the fence wire, barbed wire or wire clips referred to above. On the tool side of this end, a larger hole 6 is positioned. This hole is for the attachment of conveyance means, such as a leather strap, rope or cord.

Figure 2:
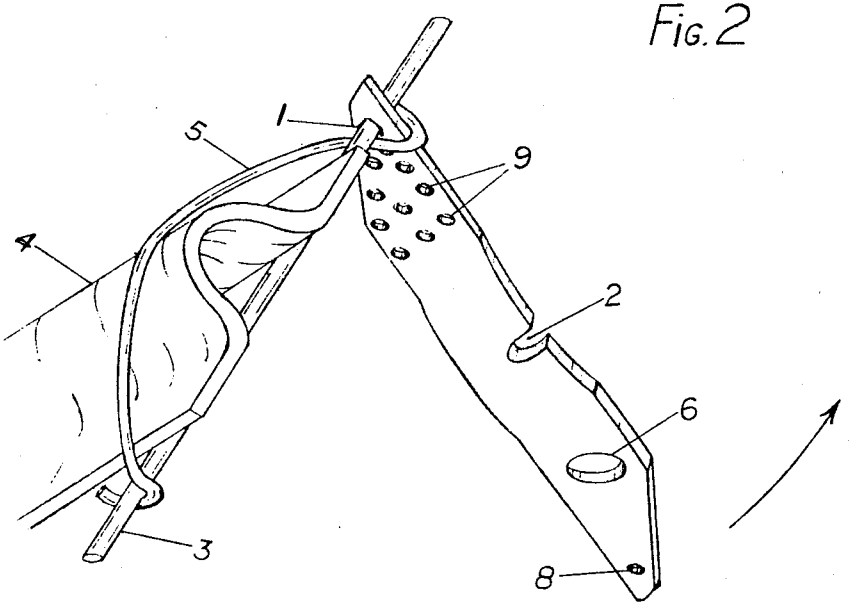
FIG. 2 is a cut-away view showing the apparatus being used to fasten fence wire to a post using a wire clip.

Referring to FIG. 2, there is illustrated a cut-away view showing the Fencewrench tool positioned to fasten fence wire 3 to metal fence post 4 using a wire clip 5. With fence wire 3 positioned against post 4 and wire clip 5 having one end coiled around fence wire 3, said wire clip 5 is then positioned to encircle post 4 away from fence wire 3 and have its unattached end, which is shaped in a hook fashion, positioned to cross under fence wire 3. The Fencewrench's tapered end containing slot 1 is inserted through said wire clip 3 hook and positioned so that fence wire 3 extends through slot 1, thus allowing the Fencewrench wrench to pivot around fence wire 3. As upward movement pressure is applied to the Fencewrench and against the wire clip hook, said wire clip hook is forced to coil about fence wire 3, thus securing fence wire 3 to post 4.

Figure 3:
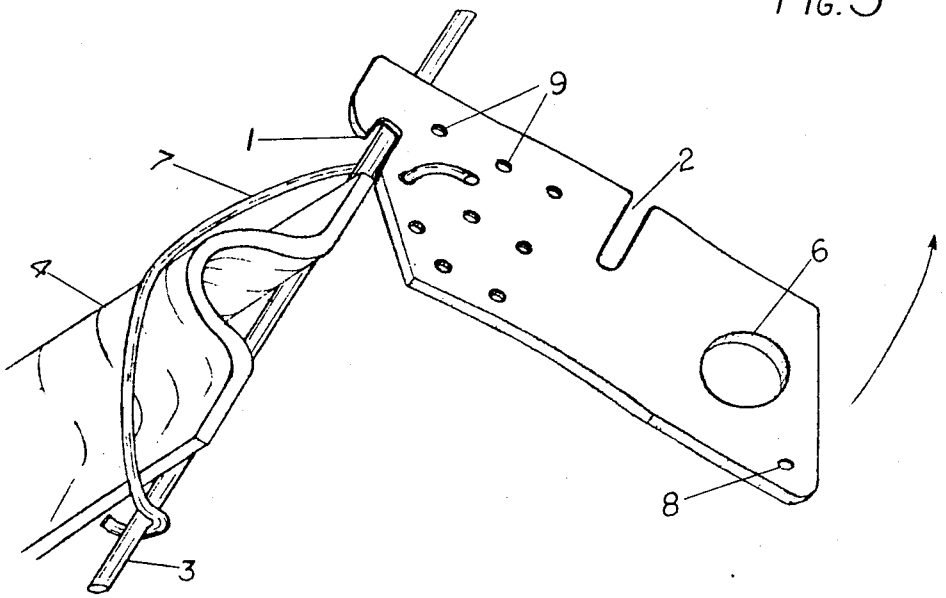
FIG. 3 is a cut-away view showing the apparatus being used to fasten fence wire to a post using another type wire clip.

Referring now to FIG. 3, there is illustrated a cut-away view showing the Fencewrench tool positioned to fasten fence wire 3 to fence post 4 using wire clip 7. With fence wire 3 positioned against post 4 and wire clip 7 having one end coiled around fence wire 3, said wire clip 7 is then positioned to encircle post 4 away from fence wire 3 and have its unattached end, which is straight, positioned to cross under fence wire 3. The Fencewrench's tapered end, containing the series of holes 9, is positioned with the tapered side next to post 4 and has the unattached straight end of wire clip 7 inserted through a selected hole 9. As upward movement pressure is applied to the Fencewrench, using fence wire 3 as a pivot, wire clip 7 is drawn in a coil around fence wire 3, thus securing fence wire 3 to post 4.

Slot 2, positioned near the center of the Fencewrench tool, can be used to tighten sagging wire by inserting the sagging wire into said slot and applying force to the tool either clockwise or counterclockwise, thus creating a crimp in said wire. By repeating this process at selected positions on the sagging wire, the crimps created will tighten the span of wire to the desired tension.

Hole 8, located at the opposite sloping end from slot 1 of the Fencewrench tool can be used for removing a wire clip from around a metal post by inserting the end of the wire clip coil into the hole 8 and uncoiling it from the fence wire. The tapered ends of the Fencewrench tool are necessary to allow the tool to slide past the metal post, when fastening wire clips, as shown in FIG. 3, or when removing wire clips by using the opposite sloping end and hole 8.

It is to be understood that the foregoing drawings and description of the invention is to be taken as a preferred embodiment and the various other modifications will occur to those skilled in the art upon reading the disclosure, however all changes and modifications that come within the spirit of the invention are desired to be protected.

I claim:

1. A tool for attaching wire clips to fence wire and securing same to metal posts, for removal of wire clips and for tightening sagging wire, comprising a. a semi-flat, oblong apparatus with tapered ends, b. one tapered end containing a slot, creating a buttonhook design, said slot being of sufficient depth and width to accommodate a selected wire, c. a selected number of holes positioned across the width of said apparatus adjacent to said slot, said holes each being of sufficient diameter to accommodate a selected wire, d. a slot positioned on the opposite side of said holes from said tapered end containing a slot, and being of sufficient depth and width to accommodate a selected wire, e. one hole positioned in the opposite tapered end from the tapered end containing a slot, and being of sufficient diameter to accommodate a selected wire, f. one hole positioned near the hole located in the tapered end, and being of sufficient diameter to accommodate means of conveyance.

2. A method of manufacturing a tool for attaching wire clips to fence wire and securing same to metal posts, for removal of wire clips and for tightening sagging wire, comprising the steps of a. having a semi-flat, oblong apparatus with tapered ends, b. installing a slot in one tapered end, creating a buttonhook design, said slot being of sufficient depth and width to accommodate a selected wire, c. installing a selected number of holes across the width of said apparatus adjacent to said slot, said holes each being of sufficient diameter to accommodate a selected wire, d. installing a slot on the opposite side of said holes from said tapered end containing a slot, and being of sufficient depth and width to accommodate a selected wire, e. positioning one hole in the opposite tapered end from the tapered end containing a slot, and being of sufficient diameter to accommodate a selected wire, f. installing one hole near the hole located in the tapered end, and being of sufficient diameter to accommodate means of conveyance.

* * * * *